US009975267B2

(12) United States Patent
Brännström et al.

(10) Patent No.: US 9,975,267 B2
(45) Date of Patent: May 22, 2018

(54) METHOD FOR PRODUCING A LAMELLA CORE

(71) Applicant: Välinge Innovation AB, Viken (SE)

(72) Inventors: Hans Brännström, Höganäs (SE); Agne Pålsson, Hasslarp (SE); Marcus Bergelin, Lerberget (SE)

(73) Assignee: VALINGE INNOVATION AB, Viken (SE)

( * ) Notice: Subject to any disclaimer, the term of this patent is extended or adjusted under 35 U.S.C. 154(b) by 692 days.

(21) Appl. No.: 14/468,763

(22) Filed: Aug. 26, 2014

(65) Prior Publication Data

US 2015/0059927 A1 Mar. 5, 2015

(30) Foreign Application Priority Data

Aug. 27, 2013 (SE) ..... 1350979

(51) Int. Cl.
*B27D 1/06* (2006.01)
*B27M 3/00* (2006.01)

(52) U.S. Cl.
CPC ..... *B27D 1/06* (2013.01); *B27M 3/0026* (2013.01); *B27M 3/0053* (2013.01)

(58) Field of Classification Search
CPC ... B27D 1/04; B27D 1/06; B27D 1/08; B27D 1/086; B27M 3/0013; B27M 3/0026; B27M 3/0053; B27M 3/006
See application file for complete search history.

(56) References Cited

U.S. PATENT DOCUMENTS

| | | | |
|---|---|---|---|
| 1,925,068 | A | 8/1933 | Gray |
| 1,995,264 | A | 3/1935 | Mason |
| 2,026,511 | A | 12/1935 | Storm |
| 2,062,590 | A | 12/1936 | Lundquist |
| 2,113,076 | A | 4/1938 | Bruce |

(Continued)

FOREIGN PATENT DOCUMENTS

| | | | |
|---|---|---|---|
| CA | 430631 | A | 10/1945 |
| CA | 2 363 184 | A1 | 7/2001 |

(Continued)

OTHER PUBLICATIONS

Pervan, Darko, U.S. Appl. No. 14/825,719 entitled "Panel Forming," filed Aug. 13, 2015.

(Continued)

*Primary Examiner* — Matthew G Katcoff
(74) *Attorney, Agent, or Firm* — Buchanan Ingersoll & Rooney P.C.

(57) ABSTRACT

A method of producing a semi-product for a building panel, wherein the method includes the step of: arranging at least two distance strips, on a first sawn timber board; arranging a second saw timber board to the distance strips; applying a glue; positioning of the first and the second sawn timber board and the distance strips by applying a pressure; and applying a pressure on the first and the second sawn timber board by a third and a fourth element, in a direction perpendicular to a top surface of the second sawn timber board, until the distance strips is bonded by the glue to the first and the second sawn timber board and thereby obtaining a solid batch; and cutting of said solid batch in the length direction of the first and the second timber boards.

14 Claims, 12 Drawing Sheets

(56) References Cited

U.S. PATENT DOCUMENTS 2,141,708 A 12/1938 Elmendorf
2,149,026 A 2/1939 McBride
2,269,926 A 1/1942 Crooks
2,324,628 A 7/1943 Kahr
RE22,687 E * 11/1945 Gramelspacher ..... B27D 1/083 144/256.1
2,652,600 A 9/1953 Burke
2,706,164 A 4/1955 Hervey
2,717,420 A 9/1955 Georges
2,740,167 A 4/1956 Rowley
2,826,521 A 3/1958 Robinson
2,914,815 A 12/1959 Alexander
3,234,074 A 2/1966 Bryant
3,333,384 A 8/1967 Brady
3,363,378 A 1/1968 Palfey
3,440,790 A 4/1969 Nerem
3,488,904 A 1/1970 Schneller et al.
3,548,559 A 12/1970 Levine
3,732,138 A 5/1973 Almog
3,841,958 A 10/1974 Delorme
3,888,061 A 6/1975 Kahr
3,895,144 A 7/1975 Kiefer
4,093,762 A 6/1978 Kiefer
4,122,878 A 10/1978 Kohn
RE30,233 E 3/1980 Lane et al.
4,242,390 A 12/1980 Nemeth
4,297,817 A 11/1981 Bullock et al.
4,388,133 A * 6/1983 Hirao ..... B27D 1/08 156/242
4,471,012 A 9/1984 Maxwell
4,646,494 A 3/1987 Saarinen et al.
4,694,627 A 9/1987 Omholt
4,716,700 A 1/1988 Hagemeyer
4,807,416 A 2/1989 Parasin
4,937,122 A 6/1990 Talbert
5,040,582 A 8/1991 Hsu
5,098,762 A 3/1992 Nakajima
5,103,614 A 4/1992 Kawaguchi et al.
5,109,898 A 5/1992 Schacht
5,255,726 A 10/1993 Hasegawa et al.
5,295,341 A 3/1994 Kajiwara
5,349,796 A 9/1994 Meyerson
5,462,623 A 10/1995 Day
5,493,839 A 2/1996 Sax et al.
5,496,648 A 3/1996 Held
5,497,589 A 3/1996 Porter
5,526,625 A 6/1996 Emblin et al.
5,540,025 A 7/1996 Takehara
5,755,068 A 5/1998 Ormiston
5,776,580 A 7/1998 Rasmussen et al.
5,798,160 A 8/1998 Kohn
5,879,781 A 3/1999 Mehta et al.
5,899,038 A 5/1999 Stroppiana
5,900,099 A 5/1999 Sweet et al.
5,968,625 A 10/1999 Hudson
5,985,398 A 11/1999 Bellegarde
6,006,486 A 12/1999 Moriau et al.
6,101,778 A 8/2000 Martensson
6,148,884 A 11/2000 Bolyard
6,162,312 A * 12/2000 Abney ..... B27D 1/04 144/346
6,182,413 B1 2/2001 Magnusson
6,209,278 B1 4/2001 Tychsen
6,212,838 B1 4/2001 Eda
6,217,976 B1 * 4/2001 MacPherson ..... B27D 1/04 428/106
6,247,285 B1 6/2001 Moebus
6,314,759 B1 11/2001 Nihashi
6,332,733 B1 12/2001 Hamberger et al.
6,412,245 B1 7/2002 Lane et al.
6,446,405 B1 9/2002 Pervan
6,505,452 B1 1/2003 Hannig et al.
6,532,709 B2 3/2003 Pervan
6,546,691 B2 4/2003 Leopolder
6,591,568 B1 7/2003 Palsson
6,606,834 B2 8/2003 Martensson et al.
6,676,199 B2 1/2004 Buisson et al.
6,679,011 B2 1/2004 Beck et al.
6,722,809 B2 4/2004 Hamberger et al.
6,761,008 B2 7/2004 Chen et al.
6,769,218 B2 8/2004 Pervan
6,772,568 B2 8/2004 Thiers
6,786,019 B2 9/2004 Thiers
6,804,926 B1 10/2004 Eisermann
6,922,964 B2 8/2005 Pervan
6,933,043 B1 8/2005 Son et al.
6,953,105 B2 10/2005 Rust et al.
7,021,346 B2 4/2006 Chang
7,386,963 B2 6/2008 Pervan
7,418,874 B2 * 9/2008 Leitinger ..... B27G 1/00 73/826
7,506,481 B2 3/2009 Grafenauer
7,665,263 B2 2/2010 Yau
7,918,062 B2 4/2011 Chen
7,971,401 B2 7/2011 Preiss
7,993,731 B2 8/2011 Miller et al.
8,029,880 B2 10/2011 Liu
8,033,075 B2 10/2011 Pervan
8,061,104 B2 11/2011 Pervan
8,202,389 B2 * 6/2012 Handojo ..... B27D 1/06 156/250
8,209,841 B2 7/2012 Kanade et al.
8,245,477 B2 8/2012 Pervan
8,381,488 B2 2/2013 Pervan
8,418,427 B2 4/2013 Strickland et al.
8,419,877 B2 4/2013 Pervan et al.
8,646,183 B2 2/2014 Tompkins et al.
8,720,151 B2 5/2014 Pervan
8,784,587 B2 7/2014 Lindgren et al.
8,850,769 B2 10/2014 Pervan
8,875,464 B2 11/2014 Pervan
8,895,125 B2 * 11/2014 Fischer ..... B27D 1/04 156/250
8,935,899 B2 1/2015 Bergelin et al.
9,140,010 B2 9/2015 Pervan
9,194,135 B2 11/2015 Pervan
9,222,267 B2 12/2015 Bergelin et al.
9,314,936 B2 4/2016 Pervan
9,482,015 B2 11/2016 Pervan
9,556,623 B2 1/2017 Pervan
9,663,956 B2 5/2017 Pervan
9,714,515 B2 7/2017 Pervan
9,758,966 B2 9/2017 Bergelin et al.
9,758,972 B2 9/2017 Pervan
9,840,849 B2 12/2017 Pervan
2002/0059765 A1 5/2002 Nogueira et al.
2002/0095894 A1 7/2002 Pervan
2002/0100231 A1 8/2002 Miller
2003/0010434 A1 1/2003 Grenier
2003/0033777 A1 2/2003 Thiers et al.
2003/0115812 A1 6/2003 Pervan
2003/0233809 A1 12/2003 Pervan
2004/0226243 A1 11/2004 Lin et al.
2005/0069674 A1 3/2005 Chang
2005/0102937 A1 5/2005 Pervan
2005/0123728 A1 6/2005 Reichwein et al.
2005/0208255 A1 9/2005 Pervan
2006/0035056 A1 * 2/2006 Fuzzell ..... B27D 1/04 428/105
2006/0154015 A1 7/2006 Miller et al.
2006/0179773 A1 8/2006 Pervan
2006/0194015 A1 8/2006 Sabater
2007/0151189 A1 7/2007 Yang
2007/0292656 A1 12/2007 Handojo
2008/0008871 A1 1/2008 Pervan
2008/0028707 A1 2/2008 Pervan
2008/0184647 A1 8/2008 Yau
2008/0199676 A1 8/2008 Bathelier et al.
2009/0155612 A1 6/2009 Pervan et al.
2009/0183458 A1 7/2009 Gibson
2009/0277120 A1 12/2009 Junker
2010/0129611 A1 5/2010 Sugimoto
2010/0247861 A1 9/2010 Mitchell
2010/0281810 A1 11/2010 Ruland

(56) References Cited

U.S. PATENT DOCUMENTS

| | | | |
|---|---|---|---|
| 2010/0297380 | A1 | 11/2010 | Szakola et al. |
| 2010/0300030 | A1 | 12/2010 | Pervan et al. |
| 2011/0023405 | A1 | 2/2011 | Moriau et al. |
| 2011/0154763 | A1 | 6/2011 | Bergelin et al. |
| 2012/0015131 | A1 | 1/2012 | Akarsu et al. |
| 2012/0042595 | A1 | 2/2012 | De Boe |
| 2012/0066996 | A1 | 3/2012 | Konstanczak |
| 2012/0266555 | A1 | 10/2012 | Cappelle |
| 2013/0047536 | A1 | 2/2013 | Pervan |
| 2013/0065072 | A1 | 3/2013 | Pervan |
| 2013/0145707 | A1 | 6/2013 | Pervan |
| 2013/0199120 | A1 | 8/2013 | Bergelin et al. |
| 2013/0260089 | A1 | 10/2013 | Gorby |
| 2013/0273244 | A1 | 10/2013 | Vetter |
| 2013/0283720 | A1 | 10/2013 | Pervan et al. |
| 2014/0000197 | A1 | 1/2014 | Pervan |
| 2014/0215952 | A1 | 8/2014 | Pervan |
| 2015/0090400 | A1 | 4/2015 | Bergelin et al. |
| 2015/0345153 | A1 | 12/2015 | Pervan |
| 2016/0194883 | A1 | 7/2016 | Pervan |
| 2016/0208501 | A1 | 7/2016 | Pervan |
| 2016/0265234 | A1 | 9/2016 | Pervan |
| 2016/0265236 | A1 | 9/2016 | Pervan |
| 2017/0114550 | A1 | 4/2017 | Pervan |
| 2017/0268238 | A1 | 9/2017 | Pervan |

FOREIGN PATENT DOCUMENTS

| | | | |
|---|---|---|---|
| CA | 2 463 192 | A1 | 10/2005 |
| CH | 173818 | | 12/1934 |
| CH | 310904 | | 11/1955 |
| CN | 2401633 | Y | 10/2000 |
| DE | 908 913 | C1 | 4/1954 |
| DE | 2 205 232 | A1 | 8/1973 |
| DE | 33 43 601 | A1 | 6/1985 |
| DE | 33 43 601 | C2 | 6/1985 |
| DE | 43 13 037 | C1 | 8/1994 |
| DE | 299 22 649 | U | 3/2000 |
| DE | 201 08 358 | U1 | 9/2001 |
| DE | 100 49 172 | A1 | 4/2002 |
| DE | 202 17 085 | U1 | 12/2003 |
| DE | 103 00 451 | B3 | 1/2004 |
| DE | 20 2006 000 935 | U1 | 4/2006 |
| EP | 0 621 128 | A2 | 10/1994 |
| EP | 0 621 128 | B1 | 10/1994 |
| EP | 0 652 340 | A1 | 5/1995 |
| EP | 1 262 609 | A1 | 12/2002 |
| EP | 2 206 851 | A2 | 7/2010 |
| EP | 2 206 851 | A3 | 7/2010 |
| EP | 2 339 092 | A1 | 6/2011 |
| FI | 21805 | | 1/1947 |
| FR | 1.464.112 | | 7/1966 |
| FR | 2 718 175 | A1 | 10/1995 |
| GB | 291113 | | 11/1928 |
| GB | 421979 | | 12/1934 |
| GB | 519198 | | 3/1940 |
| JP | 2-194269 | A | 7/1990 |
| JP | H02-121236 | U | 10/1990 |
| JP | H03-47366 | A | 2/1991 |
| JP | 5-21027 | U | 3/1993 |
| JP | 6-158831 | A | 6/1994 |
| JP | 6-280376 | A | 10/1994 |
| JP | 7-102745 | A | 4/1995 |
| JP | 7-310426 | A | 11/1995 |
| JP | 8-021071 | A | 1/1996 |
| JP | 8-068191 | A | 3/1996 |
| JP | 8-300316 | A | 11/1996 |
| JP | 9-38906 | A | 2/1997 |
| JP | 10-299230 | A | 11/1998 |
| JP | H10-299231 | A | 11/1998 |
| JP | 11-324292 | A | 11/1999 |
| JP | 2000-027418 | A | 1/2000 |
| JP | 2000-226932 | A | 8/2000 |
| JP | 2000-265652 | A | 9/2000 |
| JP | 2000-317918 | A | 11/2000 |
| JP | 2001-145980 | A | 5/2001 |
| JP | 2001-329681 | A | 11/2001 |
| JP | 2003-027731 | A | 1/2003 |
| JP | 2003-080509 | A | 3/2003 |
| KR | 2007-0000322 | A | 1/2007 |
| NL | 1008945 | C1 | 10/1999 |
| RU | 2359093 | C2 | 6/2009 |
| SE | 9604483-9 | | 6/1998 |
| SE | 9604484-7 | | 6/1998 |
| WO | WO 94/26999 | A1 | 11/1994 |
| WO | WO 96/27719 | A1 | 9/1996 |
| WO | WO 96/27721 | A1 | 9/1996 |
| WO | WO 97/38187 | A1 | 10/1997 |
| WO | WO 97/47834 | A1 | 12/1997 |
| WO | WO 98/24994 | A1 | 6/1998 |
| WO | WO 98/24995 | A1 | 6/1998 |
| WO | WO 99/00242 | A1 | 1/1999 |
| WO | WO 99/05073 | A1 | 2/1999 |
| WO | WO 99/66152 | A1 | 12/1999 |
| WO | WO 00/66856 | A1 | 11/2000 |
| WO | WO 01/02669 | A1 | 1/2001 |
| WO | WO 01/02671 | A1 | 1/2001 |
| WO | WO 01/48331 | A1 | 7/2001 |
| WO | WO 01/54897 | A1 | 8/2001 |
| WO | WO 03/016655 | A1 | 2/2003 |
| WO | WO 03/087498 | A1 | 10/2003 |
| WO | WO 2004/080674 | A1 | 9/2004 |
| WO | WO 2004/108373 | A1 | 12/2004 |
| WO | WO 2005/040766 | A1 | 5/2005 |
| WO | WO 2006/027357 | A1 | 3/2006 |
| WO | WO 2006/043893 | A1 | 4/2006 |
| WO | WO 2006/134109 | A1 | 12/2006 |
| WO | WO 2007/068267 | A1 | 6/2007 |
| WO | WO 2007/149051 | A1 | 12/2007 |
| WO | WO 2009/065769 | A2 | 5/2009 |
| WO | WO 2009/065769 | A3 | 5/2009 |
| WO | WO 2011/141171 | A1 | 11/2011 |

OTHER PUBLICATIONS

International Search Report dated Dec. 22, 2014 in PCT/SE2014/050969, ISA/SE Patent-och registreringsverket, Stockholm, SE, 6 pages.

Bergelin, Marcus, et al., U.S. Appl. No. 14/564,653 entitled "A Lamella Core and a Method for Producing It," filed Dec. 9, 2014.

Pervan, Darko, U.S. Appl. No. 15/085,535 entitled "Panel Forming," filed Mar. 30, 2016.

Pervan, Darko, U.S. Appl. No. 15/164,523 entitled "Panel Forming," filed May 25, 2016.

Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

Drawing Figures 25/6107 from Buetec GmbH dated Dec. 16, 1985.

Pervan, Darko, U.S. Appl. No. 14/946,429 entitled "Floorboards for Floorings," filed Nov. 19, 2015.

* cited by examiner

METHOD FOR PRODUCING A LAMELLA CORE

CROSS REFERENCE TO RELATED APPLICATIONS

The present application claims the benefit of Swedish Application No. 1350979-9, filed on Aug. 27, 2013. The entire contents of Swedish Application No. 1350979-9 are hereby incorporated herein by reference in their entirety.

TECHNICAL FIELD

The disclosure generally relates to the field of cores comprising several wood lamellas and building panels, e.g. floor and wall panels, comprising such a core, a decorative surface layer and a balancing layer. Furthermore, the disclosure relates to production methods to produce such cores and panels.

BACKGROUND

It is well known to produce building panels, e.g. floor panels, comprising a wood lamella core, see e.g. CA 430 631. It is also well known to produce building panels with a mechanical locking system, see e.g. WO 1994/026999.

An engineered wood floor generally comprises of a surface layer, a core layer and a balancing layer. The core provides stability and counteracts swelling/shrinking. Several core materials may be used such as plywood, HDF boards or a lamella core comprising several wood lamellas.

SUMMARY

An overall objective of an embodiment of the disclosure is to improve the yield of the production of a wood lamella core for building panels, particularly panels comprising a mechanical locking system. A specific objective is to improve the method for producing a semi-product for a core for a building panel, such as a floorboard.

The sawn timber boards used for wood lamella cores are, due to cost reasons, normally of low grade with a high number of knots, cracks etc. Furthermore the sawn timber boards are in different lengths and the lengths seldom correspond to the exact length needed in the production. The sawn timber boards are often curved in the length direction. This causes a material waste in the production of the wood lamella core. An embodiment of the disclosure may increase the share of the incoming material that may be used in the production of building panels with a wood lamella core.

A first aspect of the disclosure is a method of producing a semi-product for a building panel, such as a floorboard, wherein the method comprises the steps of:

- arranging at least two distance strips, on a first sawn timber board, the strips are preferably arranged essentially perpendicular to the first sawn timber board;
- arranging a second sawn timber board to the distance strips;
- gluing the distance strips and the first and the second sawn timber board, respectively;
- positioning of the first and the second sawn timber board and the distance strips by a applying a pressure by a first element and a second element, which are arranged along long edges of the first and the second sawn timber board; and
- applying a pressure on the first and the second sawn timber board by a third and a fourth element in a direction perpendicular to a top surface of the second sawn timber board, preferably after the positioning step, until the distance strips are bonded to the to the first and the second sawn timber board and thereby obtaining a solid batch; and
- cutting of said solid batch in the length direction of the first and the second timber boards, preferably by a multi rip saw, a frame saw or a band saw.

The pressure applied by the first and the second element positions the first and the second sawn timber board and the distance strips in a correct position. The first and the second sawn timber board may be curved in the length direction and the pressure applied may at least partly straighten out the curved shape. The first element may be a press plate, preferably a resilient press plate comprising a plastic material.

The method may comprise the step of calibrating, preferably by milling or planing, a width of the solid batch before said cutting of said solid batch.

The material yield may be increased by calibrating the solid batch instead of calibrating the sawn timber board to obtain straight timber boards.

The first and the second sawn timber board may be calibrated by milling or planing before the method steps defined above in order to facilitate the positioning.

A length of the distance strips may be longer than a width of the first and the second sawn timber board, respectively. The first and/or the second element may be provided with recesses that matches protruding parts of the distance strips.

The distance strips may be equal or shorter than a width of the first and the second sawn timber board, respectively. If a calibrating of the solid batch is made an outer end of the distance strip may protrude from a long edge surface of the solid batch.

The first and or the second element may have a planar surface facing the long edges of the first and the second sawn timber boards.

The first and/or the second sawn timber board may be provided with grooves with a width that match a width of the distance strips.

The first and the second sawn timber board may be positioned by applying a pressure by a fifth and a sixth element at short edges of the first and second sawn timber board, preferably before applying the pressure by the first and the second element.

The first and/or the second sawn timber board may be arranged against a protruding part of the first and/or the second element. This may increase the yield if one of the first or the second sawn timber board is curved and the other straight, or if they are curved in different directions.

The method may comprise the step of arranging several sawn timber boards and distance strips to the second and/or first sawn timber board and preferably at least two distance strips between adjacent sawn timber boards. The method may comprise the step of arranging a short sawn timber board, which is shorter than the distance between two adjacent distance strips arranged on an adjacent sawn timber board. The short sawn timber board is arranged on one of the adjacent distance strips.

The gluing step preferably comprises the step of applying a glue between the distance strips and the first and the second sawn timber board, respectively.

The distance strips may comprise wood fibres and the glue may comprise a reactive adhesive, e.g. a cross-linked polymer such as a cross-linked polyurethane, a hot melt glue, or a white glue, such as a glue comprising polyvinyl acetate. The distance strips may also be of wood or may comprise wood, such as veneer, plywood, recycled parts of wood lamellas, paper, MDF, HDF, OSB, particle board, masonite or saw dust mixed with an adhesive. The distance strip may as an alternative comprise an adhesive with any type of filler or a foamed glue.

A preferred solid batch comprises at least three sawn timber boards and the cutting is preferably made by a band saw or a frame saw.

Said two distance strips, may be arranged on the first sawn timber board at an angle within the range of about 45 to about 90 degree to a long edge the first sawn timber board.

The method may comprise the step of arranging the distance strips between adjacent sawn timber boards in a straight line.

The straight line may be oriented at about 90 degrees to the longitudinal direction of the first sawn timber board.

The method may comprise the step of cutting the first and the second sawn timber boards and the distance strips in a direction perpendicular to the length direction.

Particularly if the sawn timber boards are cup shaped the method preferably comprises the steps of:

forming two grooves, preferably with essentially planar fixation surfaces, in a surface of the first sawn timber board; and arranging one of said two distance strips in each groove.

The method may preferably also comprises the steps of:

forming two grooves, preferably with essentially planar fixation surfaces, in a surface of the second sawn timber board; and arranging one of said two distance strips in each of said grooves in the surface of the second sawn timber board.

By forming grooves in the first and the second timber board planar surfaces are provided for arranging the distance strips. This has the effect that the fixation strength between the strips and the sawn timber boards are increased.

The method may comprise more than two distance strips. The number of grooves formed in the surface of the first and the second sawn timber board respectively is preferably equal to the number of distance strips.

The method may comprise the step of cutting the first and the second sawn timber board and the distance strips in the length direction several times with a distance between the cuts which is equal to the thickness of the a semi-product.

A second aspect of the disclosure is a method of producing a solid batch comprising at least two sawn timber boards. An objective of an embodiment of the second aspect is to increase the net width of the solid batch. The method comprises the step of:

measuring a deviation of a first sawn timber board; and cutting the first sawn timber board, if the deviation exceeds a critical value, to obtain a shorter first sawn timber board.

gluing the first sawn timber board to a second sawn timber board to obtain a solid batch.

The first sawn timber board may have a deviation because of a curved shape and the deviation may be decreased if the first sawn timber board is cut.

The method may comprise the step of cutting the first sawn timber board, if the deviation exceeds a critical value, to obtain a third and a fourth sawn timber board.

The method may comprise the step of cutting the first sawn timber board in the middle to obtain a third and a fourth sawn timber board with essentially the same length. The deviations of the third and the fourth sawn timber board obtained may be a quarter of the deviation of the first timber board. The net width of a solid batch comprising the third and the fourth sawn timber boards may therefore be greater than the net width of a solid batch comprising the first sawn timber board.

The method may comprise the step of arranging and gluing at least two distance strips between the first and the second sawn timber board.

The method may comprise the step of arranging and gluing at least two distance strips between the third and the second sawn timber board.

The method may comprise the step of arranging and gluing at least two distance strips between the fourth and the second sawn timber board.

The method may comprise the step of arranging and gluing at least two distance strips between the fourth and the third sawn timber board.

The cutting method steps of the second aspect to obtain an increased net width may be used to increase the yield of the solid batch production of the first aspect.

BRIEF DESCRIPTION OF THE DRAWINGS

The disclosure will in the following be described in connection to preferred embodiments and in greater detail with reference to the appended exemplary drawings, wherein.

DETAILED DESCRIPTION OF EMBODIMENTS

Figure 1A:
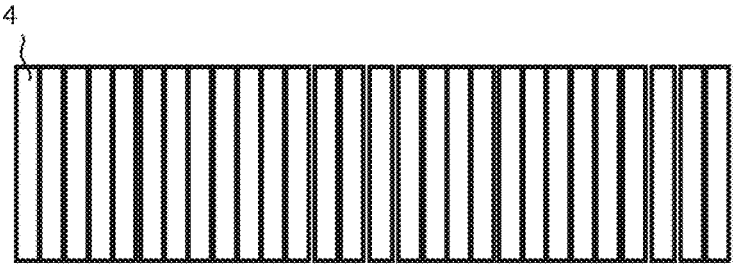
FIGS. 1A-C show the production of a wood lamella core according to known technology.

In the production of a building panel, e.g. a floor panel, with a wood lamella core it is known to arrange wood lamellas 4 parallel to each other and with a small distance between the wood lamellas as is shown in FIG. 1A. The distance is undefined and random. A surface layer 6 is applied and glued to the wood lamellas 4. The fibres in the wood lamella core are generally oriented perpendicular to the fibre direction of the surface layer 6. This provides a very climate stable floor panel when the surface layer is glued to the lamella core.

Figure 1B:
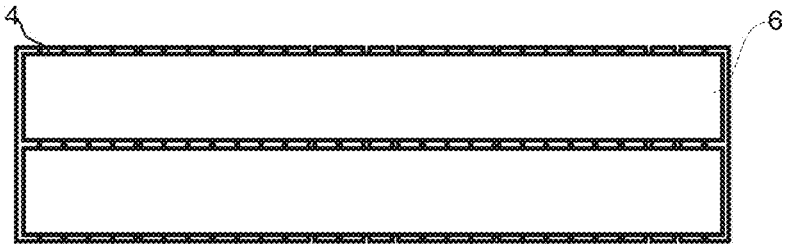
Figure 1C:
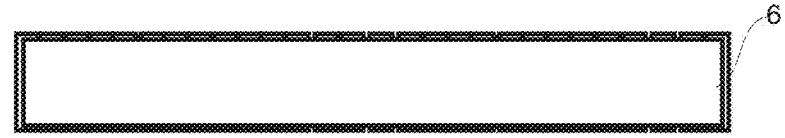

Generally the wood lamellas 4 have a length, which is equal to the width of two or several floor panels as is shown in FIG. 1B. The wood lamellas 4 are, after gluing of the surface layer 6, crosscut along a long edge of a surface layer to obtain the building panel, see FIG. 1C.

Figure 1D:
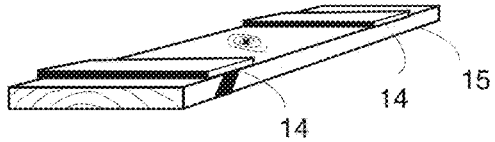
FIGS. 1D-E illustrate a sawn timber board and a batch comprising several sawn timber boards and distance strips according to an embodiment of the disclosure.
Figure 1E:
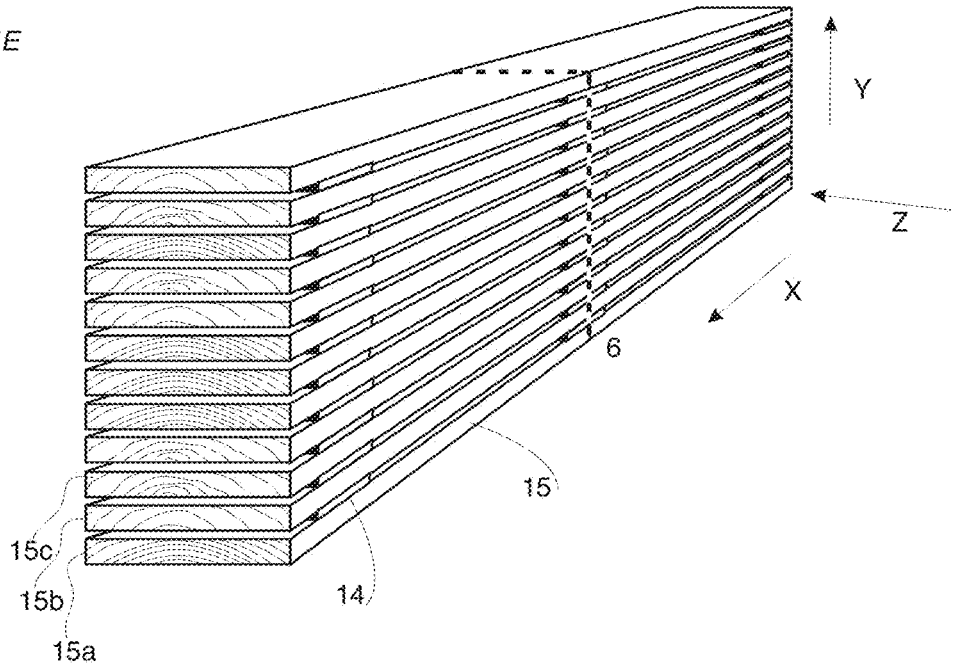

A solid batch according to an embodiment of the disclosure comprising sawn timber boards 15 and distance strips 14 are shown in FIGS. 1D and 1E. The sawn timber boards 15 may be piled vertically above each other, with a distance strip 14, preferably of wood, between adjacent sawn timber boards, or arranged in the same way in the horizontal direction. The distance strips 14, between a first 15*a* and a second 15*b* adjacent sawn timber board, and between the second and a third 15*c* adjacent sawn timber boards, are preferably arranged vertically aligned. The wood species of the sawn timber boards and/or the distance strips may be e.g. spruce, pine, rubber wood or poplar.

Figure 2:
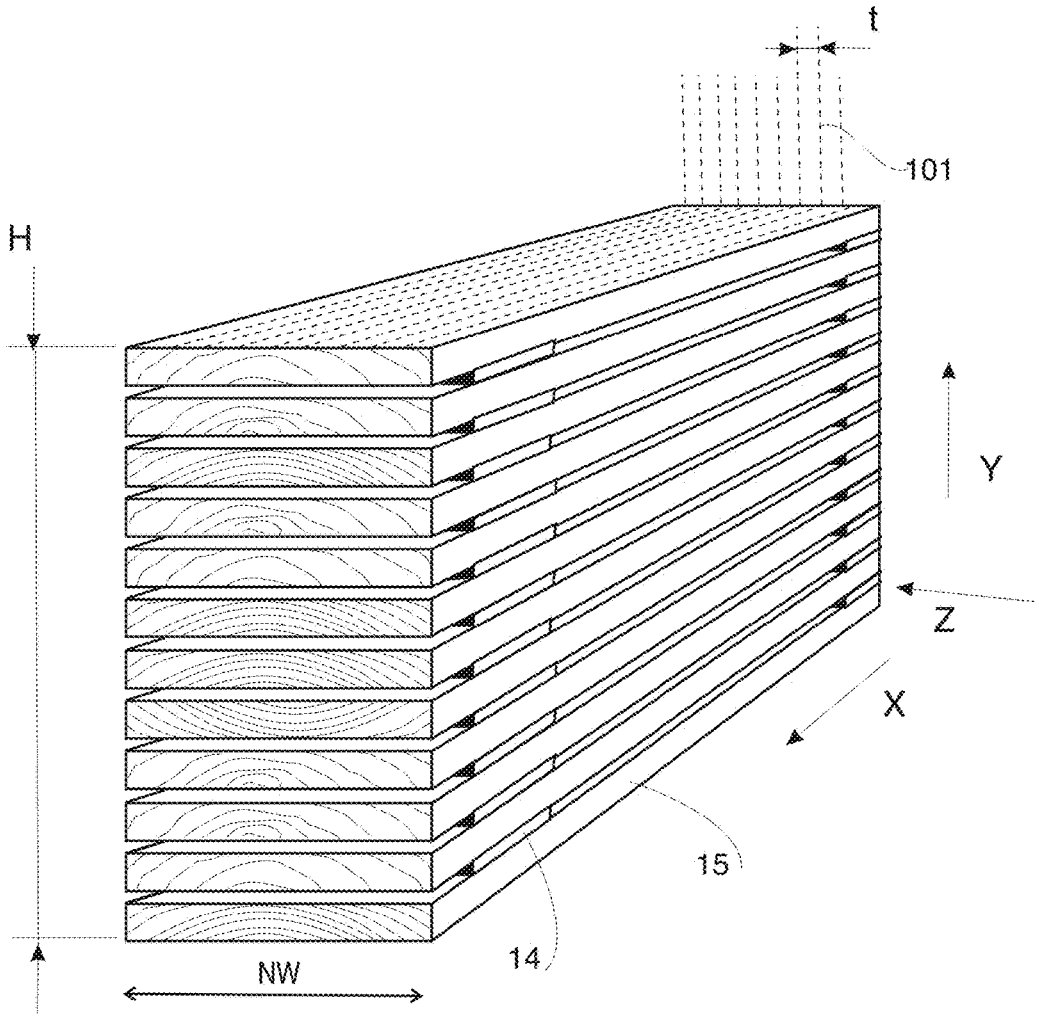
FIG. 2 illustrates a batch comprising several sawn timber boards according to an embodiment of the disclosure.

The sawn timber boards may be arranged such that the annual rings are oriented in the same way, see FIG. 1E, and preferably not opposite to each other, see FIG. 2. Different orientation of the annuals rings may cause the sawn timber boards in the batch to crack and/or separate since the sawn timber boards are cupping, due to humidity changes, in different direction. The cupping may be decreased by having narrower sawn timber boards. The sawn timber boards are preferably divided into a width, which correspond to a multiple of the thickness of desired wood lamellas plus the width of any saw cut/s between the wood lamella layers.

Figure 3A:
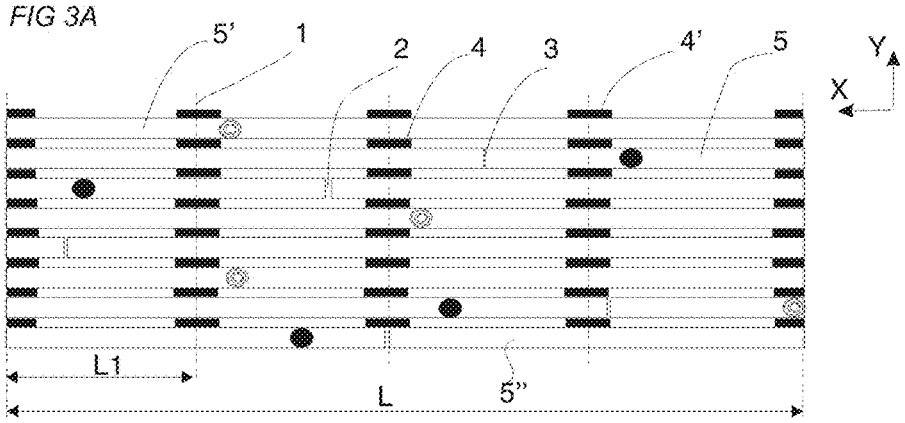
FIGS. 3A-B illustrate a semi product according to an embodiment of the disclosure.
Figure 3B:
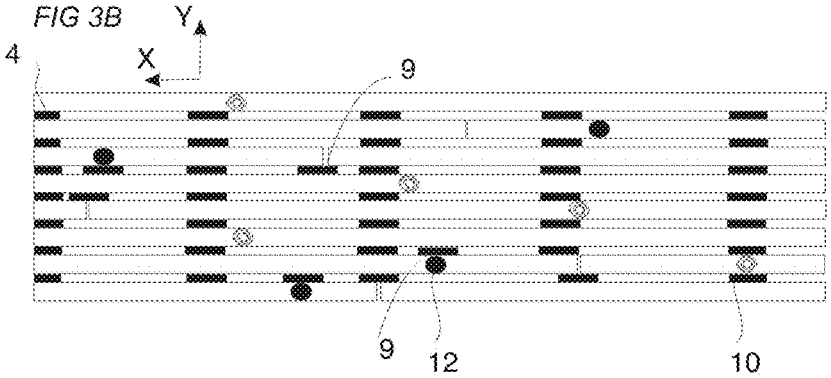

The batch may be used for producing a semi product, see FIGS. 3A and 3B. The semi product may be used in a lamella wood core of a building panel, see FIGS. 3C, 3D and 4B.

Each distance strip 14 is fixed to the adjacent(s) sawn timber boards 15 by an adhesive, e.g., such as resins, preferably cross-linked, hot melt glue, white glue, glue comprising polyvinyl acetate or polyurethane or expanding/foaming glue. The longitudinal direction Z of the distance strips 14 is preferably perpendicular to the longitudinal direction X of the sawn timber boards 15.

The sawn timber boards are divided several times by cutting in its longitudinal direction X, forming a wood lamella 5, 5', 5" of a semi product for e.g. a floorboard, as shown in FIG. 3A, and the distance strip is in the same cutting cross cut, forming a distance element 4, 4' of the semi product.

The distance t between two adjacent cuts corresponds essentially to the thickness of the semi-product and thickness of the wood lamellas. The distance L1, in the longitudinal direction of the wood lamellas X, between two adjacent distance elements 4, corresponds preferably to the width of a readymade building panel, see FIG. 3*a*. The total length L of the semi-product, in the longitudinal direction of the wood lamellas X, is preferably essentially equal to a multiple of the width, including any mechanical locking system, of a ready-made building panel.

Knots 10 or other weaknesses of the wood lamellas in the semi product may be reinforced with a reinforcement element 9, if they are not positioned at a distance element 4. The wood lamella may comprise two pieces of wood in the longitudinal direction. The short edges of two adjacent pieces may be close (e.g., less than about 2 mm) to each other 3, adjacent to each other (not shown), or positioned at some distance 2 (e.g., between 0 mm and 10 mm). The short edges close to each other may be glued to each other and the short edges positioned at some distance may be provided with a reinforcement element 9. The short edges of said two adjacent pieces may also be positioned at a distance element 4. The reinforcement element may be of the same type or of different type than the distance element.

A wood lamella 5' at the outer edge of the semi product may be provided with a distance element 4'. The purpose with this distance element 4' is to position a first semi product at the desired distance from a second semi product when the first and the second semi product is arranged next to each other, see FIGS. 3A and 4A.

Figure 3C:
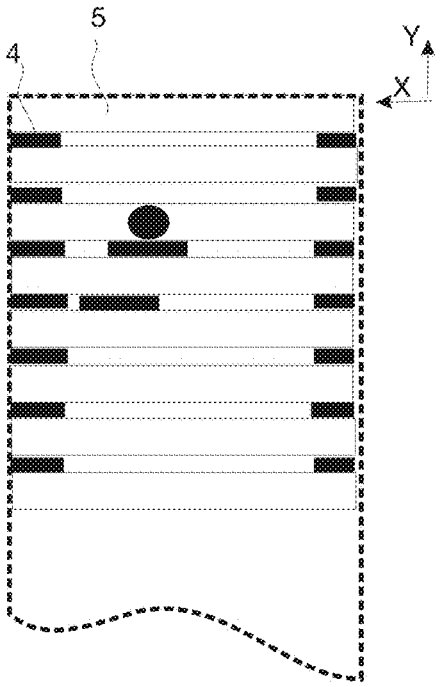
FIGS. 3C-D illustrate a building panel according to an embodiment of the disclosure
Figure 3D:
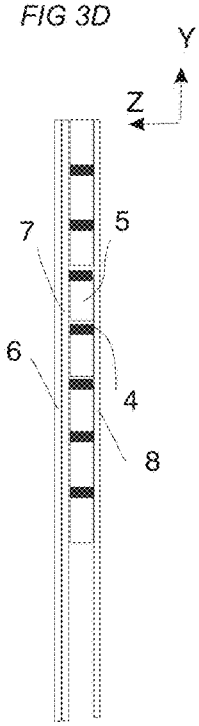

FIGS. 3C and 3D disclose a building panel, preferably a floor panel, with a core comprising the semi products described above (section L1 in FIG. 3A). The building panel is shown from above FIG. 3C and in a side view 3D. The building panel further comprises a surface layer 6, preferably comprising wood or a wood veneer, and a balancing layer 8. Optionally the building panel may comprise a supporting layer 7, e.g. a thin board or a veneer, in order to avoid telegraphing in top surface of the decorative layer 6, and at the same time the thickness of surface layer 6 may be reduced.

Figure 4A:
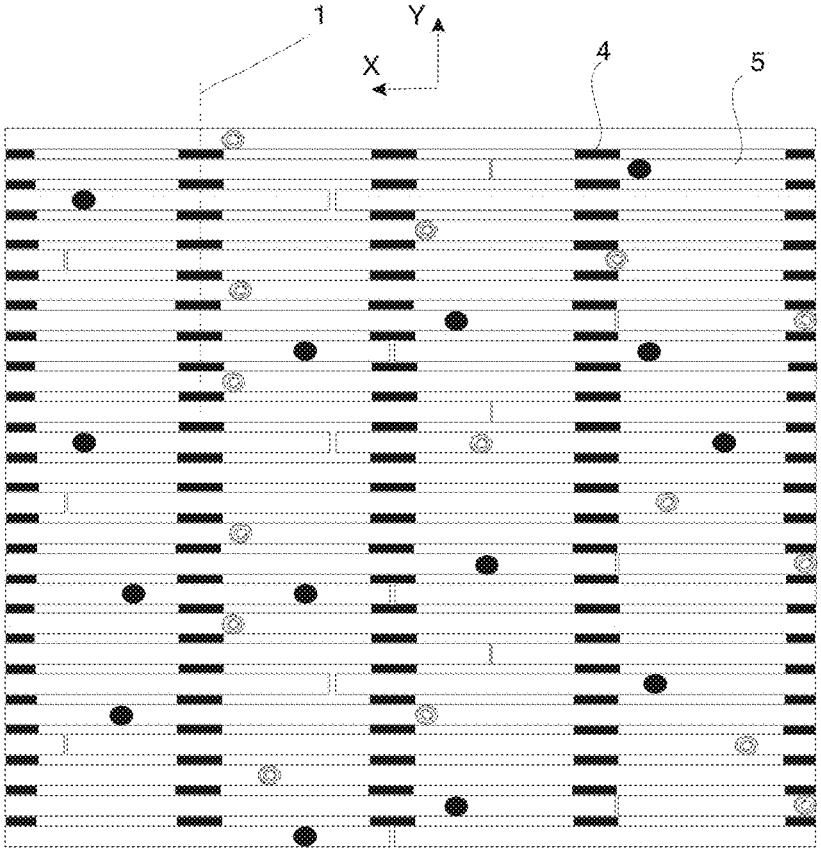
FIGS. 4A-B illustrate several semi products adjacent each other and a building panel respectively according to an embodiments of the disclosure.
Figure 4B:
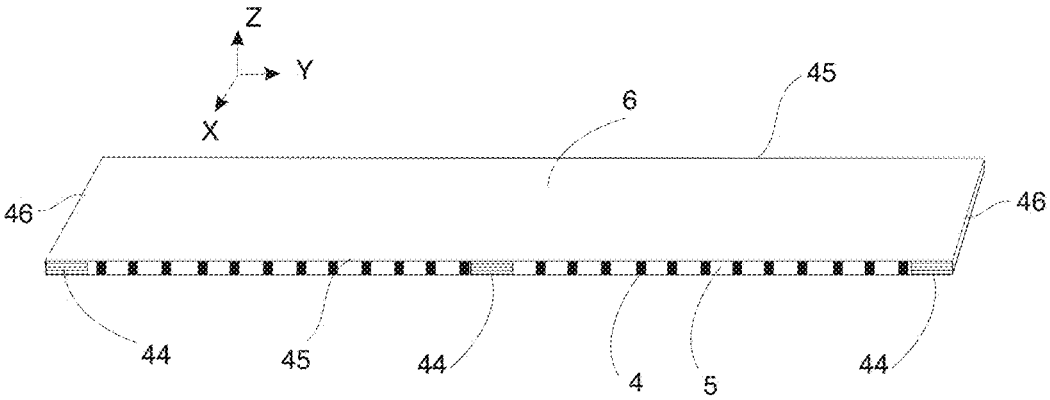

FIG. 4A discloses several semi-products arranged in a set long side to long side to be used as a core for the production of building panels, such as floorboards, see FIG. 4B. In the production of building panels several decorative layers 6 may be positioned on one side of said set, preferably with their longitudinal direction perpendicular to the longitudinal direction of the wood lamellas 5 of the semi products. The length of the set, in a direction Y perpendicular to the longitudinal direction of the wood lamellas 5 in the semi products, is preferably about the same as the length of a readymade building panel.

A long edge 45 of a decorative layer 6 may be arranged along a line 1 of distance elements 4. A balancing layer 8 may be arranged on the other side of the set at each position of a decorative layer 6. The set is preferably cut along said line 1 and a mechanical locking system formed along the long edges of the building panel.

A core material of different material 44, e.g. a piece of plywood, may be positioned in the set at a position, which corresponds to a short edge 46 of the decorative layer. Different material 44 may be positioned at both short edges 46 of the decorative layer. Preferably a mechanical locking system is produced along the short edges of the decorative layer and in the core material of different material. A core material of different material 44, e.g. a piece of plywood, may also be positioned in the set at a position that is essentially in the middle of the decorative layer, or at any position where it may be desired to crosscut the building panel and provide the edge with a mechanical locking system.

Figure 5A:
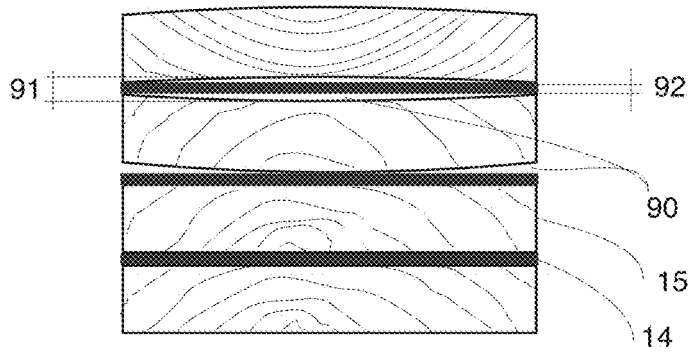
FIGS. 5A-D illustrate a batch and a sawn timber board with a groove and a batch comprising such sawn timber boards according to embodiments of the disclosure.
Figure 5B:
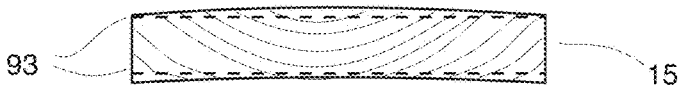
Figure 5C:
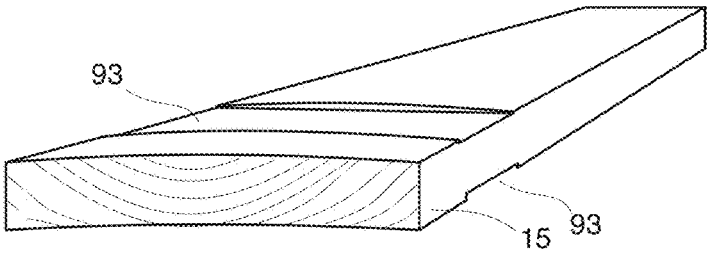
Figure 5D:
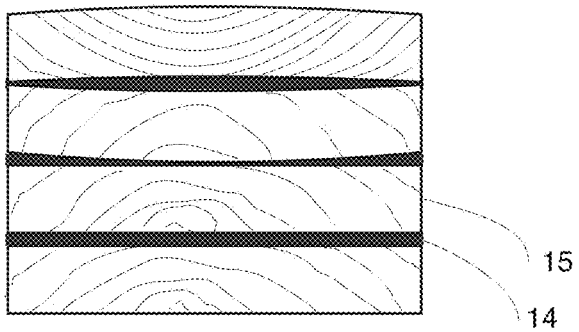

FIG. 5A shows a batch comprising cup shaped sawn timber boards and non-cup shaped sawn timber boards 15. The fixation strength between a distance strip 14 and a cup shaped sawn timber boards is reduced since the distance 91, 92 between two adjacent sawn timber boards varies over the width of the adjacent sawn timber boards. The distance variation may also result in that the sawn timber boards crack when the sawn timber boards in the batch are pressed together after that glue is applied between the distance strips and the sawn timber boards. To improve the fixation strength to a cup shaped sawn timber board a groove 93, with a planar fixation surface, is formed in the surface of the sawn timber board 15, as is shown in FIGS. 5B-C. The distance strip 14 is attached in the groove, preferably by gluing the distance strip to the fixation surface. FIG. 5D shows a batch with straight and cup shaped sawn timber boards 15, which are provided with grooves 93 and distance strips 14 glued to the fixation surfaces of the grooves.

Figure 6A:
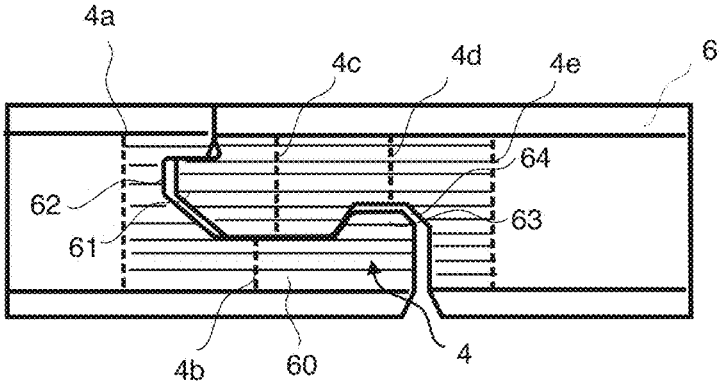
FIGS. 6A-C illustrate a locking system with a protruding strip comprising different sections according to an embodiment of the disclosure.
Figure 6B:
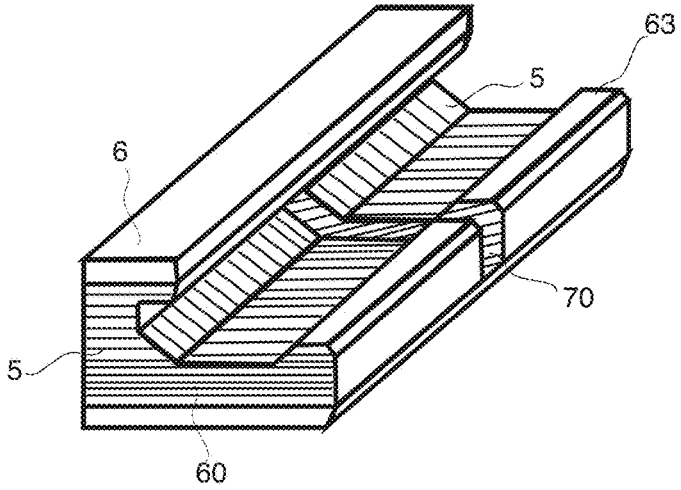
Figure 6C:
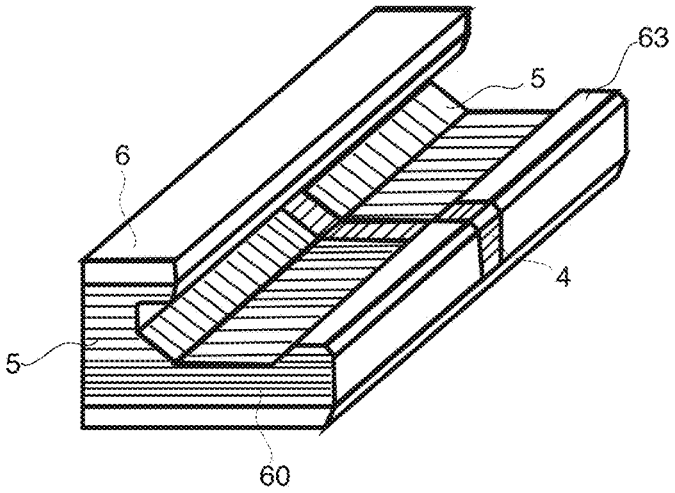

FIGS. 6A-C show a building panel comprising a wood lamella core and a surface layer 6. A first wood lamella 5 is fixed to a second adjacent wood lamella by a distance element 4. The building panel is provided with a long edge locking system. The locking system comprises a first locking device at a first long edge and a second locking device at a second opposite long edge. The first locking device comprises a groove 62 and a protruding strip 60 with a locking element 63 at a first long edge. The second locking device comprises a locking groove 64 and tongue 61.

The first locking device is configured to cooperate with the second locking device at an essentially identical adjacent building panel. The tongue 61 and the groove 62 cooperate for vertical locking of the first and the second edge of said two essentially identical building panels. The locking element 63 and the locking groove 64 cooperate for horizontal locking of the first and the second edge of said two essentially identical building panels.

The distance element 4 at the first edge preferably extends to an inner position 4*a* such that it covers essentially the whole groove 62. The advantage is that there is no open space 70 at the edge and between the wood lamellas 5, see FIG. 6B, for accumulation of dust and splinters. Preferably the distance element 4 extends to an outer position at the outer edge of the locking element. This gives a strong locking and a more smooth machining since splitting of the locking element 63 at the outer edge of the wood lamella may be avoided, since the adjacent wood lamellas 5 are glued to the distance element 4 as shown in FIG. 6C.

The distance element 4 at the first edge may also extend to an outer position 4*b* such that only a part of the strip 60 is covered. The distance element 4 may also extend to an inner position such that an opening is created between adjacent wood lamellas.

The locking system is made even stronger vertically if the distance element 4 at the second edge extends to the outer end of the tongue and to an inner position 4*c* such that the distance element 4 covers the whole tongue 61. The horizontal strength is improved if the distance element at the second edge extends to an inner position 4*d*, such that the distance element covers a part of the locking groove 64, that cooperates with the locking element 63 for horizontal locking.

The distance element 4 at the second edge may also extend to an inner position 4*e*, such that the distance element covers essentially the whole locking groove 64, in order to avoid accumulation of dust and splinters.

A preferred locking system of the building panel comprises a locking strip 60, which comprises a first section, with a first wood fibre direction, and a second section with a second wood fibre direction. In the embodiments shown in FIG. 6*a-c* the first section is created by a wood lamella and the second section is created by the distance element.

A locking system of the building panel may further comprise a protruding strip 60 that comprises sections with different materials and/or widths along the joint.

Figure 7A:
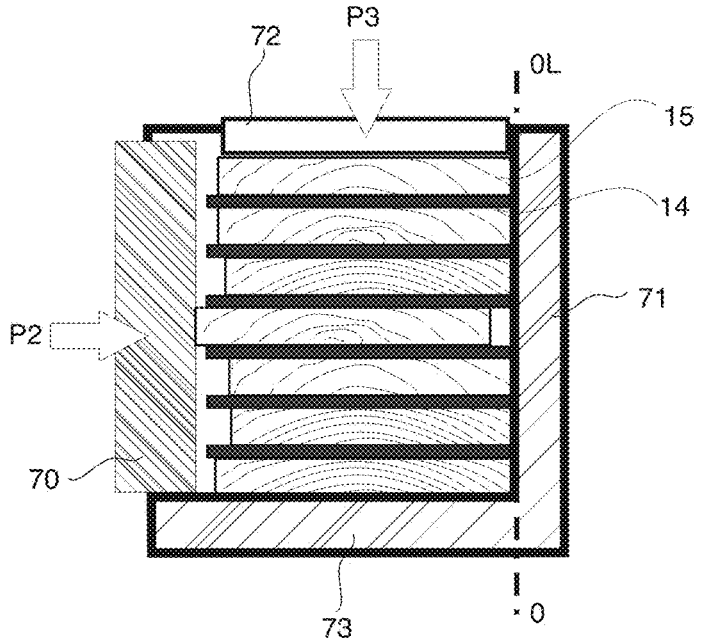
FIGS. 7A-B illustrate a method and a device for producing a batch according to an embodiment of the disclosure.
Figure 7B:
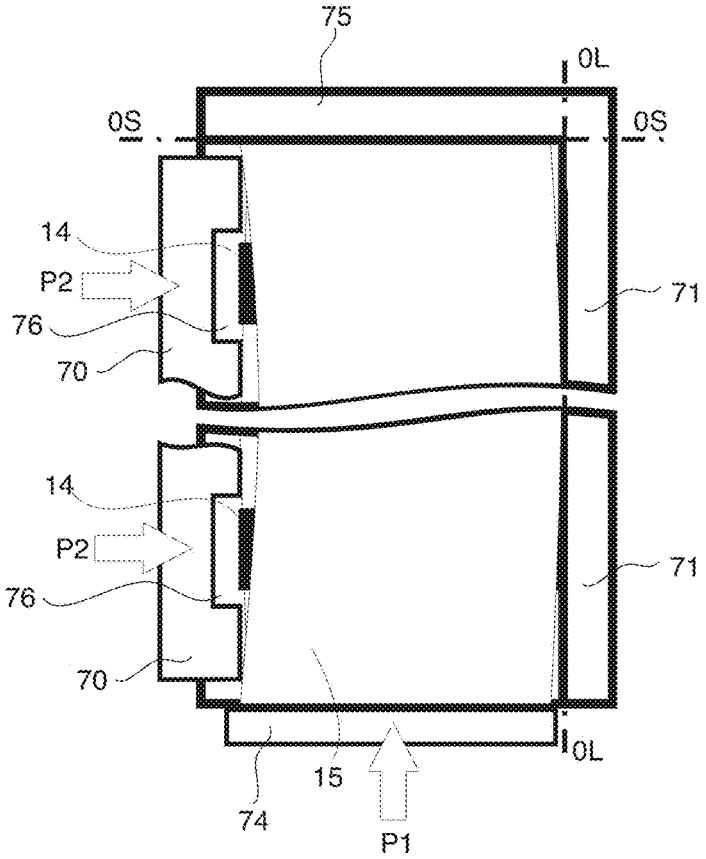

A method and a device for producing a semi-product for a core of a building panel, such as a floorboard, is shown in a side view in FIG. 7A and in a top view in FIG. 7B. Sawn timber boards are arranged on each other with at least two distance strips 14 between adjacent sawn timber boards 15 and glue is applied between the distance strips and the sawn timber boards. A pressure P2 is applied against first long edges of the sawn timber boards by a first element 70, such a press plate, which positions second long edges of the sawn timber boards against a second element 71. A pressure P3 is applied on a top surface on the uppermost of the sawn timber board by a third element 72, such as a press plate, which presses the sawn timber boards against a fourth element 73. The pressure against the top surface is maintained until the distance strips are bonded by the glue to the sawn timber board and thereby obtaining a solid batch comprising the sawn timber boards and the distance strips. The pressure against the long edges of the sawn timber boards is preferably also maintained until the distance strips is bonded by the glue to the sawn timber board. The pressure against the long edges may at least partly straighten out curved sawn timber boards. A pressure may also be applied against first short edges of the sawn timber board by fifth element 74, which positions second short edges of the sawn timber board against a sixth element 75.

The sawn timber boards are piled on the fourth element 73, which preferably extends in a horizontal plane, and the first long edge of each sawn timber board is positioned against the second element 71, which preferably extends in a vertical plane. The fourth element, such as a plate may be connected to the second element, such as a plate, to a frame with a L-shaped cross section. The sawn timber boards may be positioned against the sixth element 75, which preferably extend in a vertical plane. The sixth element is preferably connected to an end of the frame. The frame may be arranged in an angled position such that the sawn timber boards are displaced by gravity against the second and/or the sixth element. The length of the distance strips may be greater than the width of the sawn timber boards and the first and/or the second element may be provided with recesses 76 that matches protruding parts of the distance strips 14. Two or more bars may be used instead of a plate (not shown).

The sawn timber board may have different width. It is preferred that sawn timber boards of different width are positioned such that the second long edges of the sawn timber board are positioned essentially in the same plane 0 L at the second element to obtain a solid batch with a second long edge surface which is essentially flat. Thus the deviations of the width of the sawn timber boards preferably end up at a first long edge surface of the solid batch. To obtain this the first element 70 is preferably resilient, such as a press plate comprising a plastic material, whereas the second element is more rigid, such as a plate comprising a metal.

The sawn timber board may have different length. It is preferred that sawn timber boards of different lengths are positioned such that the second short edges of the sawn timber board are positioned essentially in the same plane 0 S at the sixth element to obtain a solid batch with a second short edge surface which is essentially flat. Thus the deviations of the length of the sawn timber boards preferably end up at a first short edge surface of the solid batch. To obtain this the fifth element is preferably resilient, such as a press plate comprising a plastic material, whereas the sixth element is more rigid, such as a plate comprising a metal.

Figure 8A:
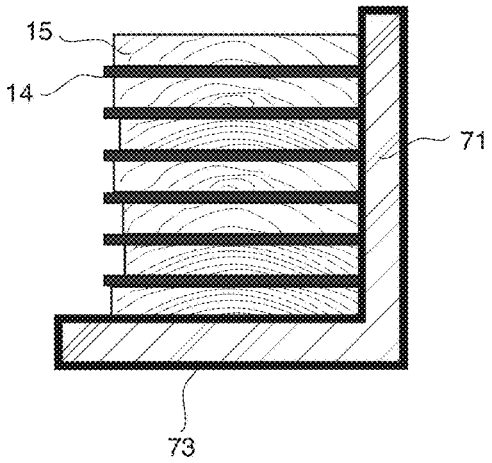
FIGS. 8A-D illustrate a method and a device for producing a batch according to an embodiment of the disclosure.
Figure 8C:
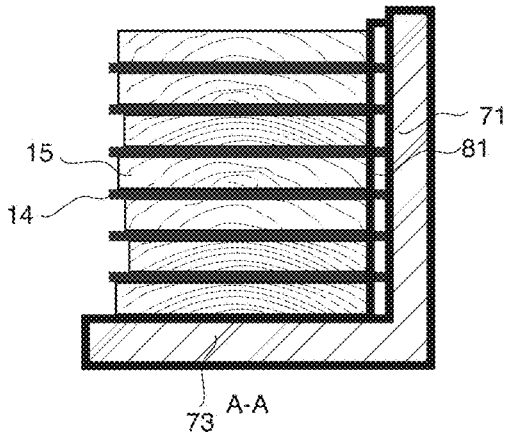
Figure 8B:
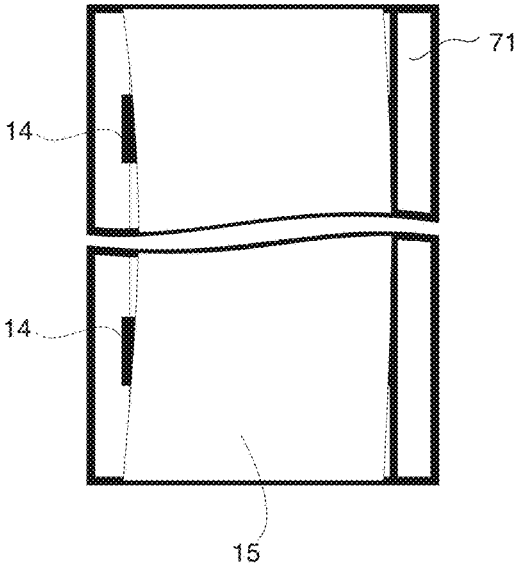
Figure 8D:
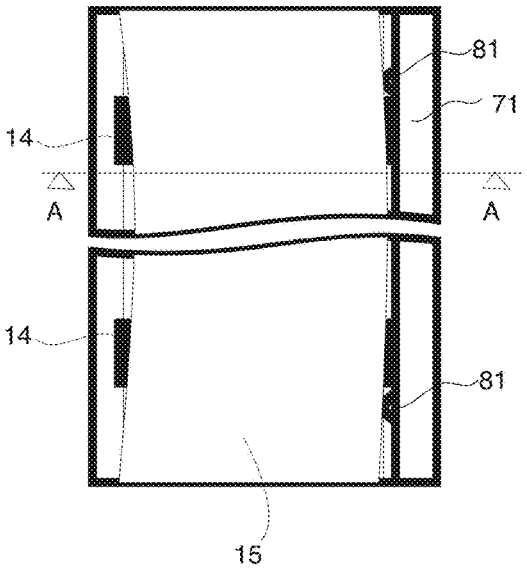

An embodiment of the method and the device for producing the semi-product is shown in FIG. 8C in a top view and in FIG. 8D in a cross section A-A. The sawn timber boards 15 are positioned against two protruding parts 81 arranged at the second element 71. The protruding parts 81 extends along the second element in the vertical direction and one of the protruding part is positioned at a distance from an end of the second element and the other of the protruding part is preferably positioned at the same distance from the other end of the second element. Deviations of a curved sawn timber board 15, as compared to a straight board, which are not removed by the pressure P1 form the first element, are allocated on the first and the second long edge of the solid batch. This may decrease the waste as compared to the method and device without the protruding parts which is shown in corresponding views in FIGS. 8A-B.

Figure 9A:
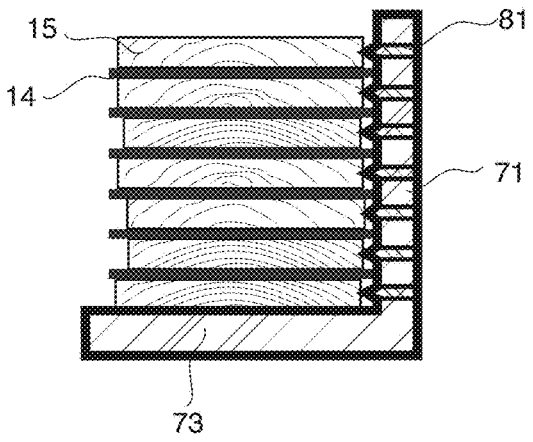
FIGS. 9A-F illustrate a method and a device for producing a batch according to an embodiment of the disclosure
Figure 9B:
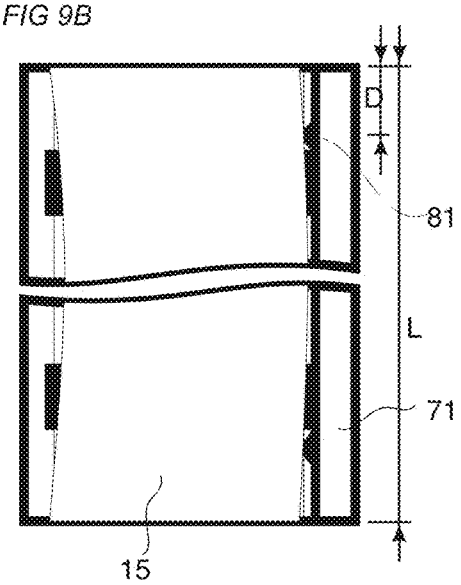

FIGS. 9A-B shows an embodiment comprising a first and a second set protruding parts. Each set comprising protruding parts arranged vertically above each other. Each protruding part is arranged at a position that corresponds to a vertical position of a sawn timber board. The first set is positioned at a distance D from an end of the second element and the second set is preferably positioned at the same distance from the other end of the second element. The protruding parts are preferably displaceable in a horizontal direction and may be individually adjustable in order to position sawn timber boards that may be curved and/or of different width to obtain a decreased waste.

Figure 9C:
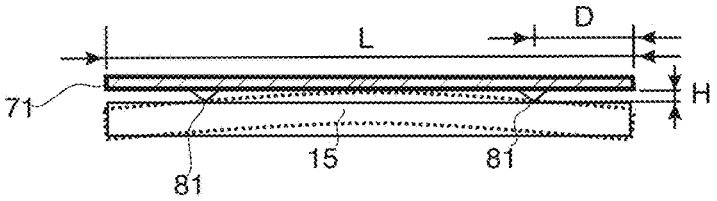
Figure 9D:
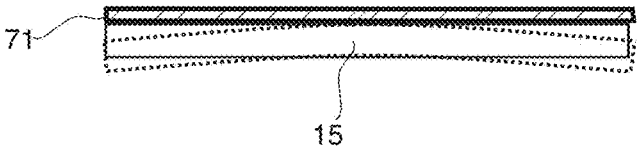
Figure 9E:
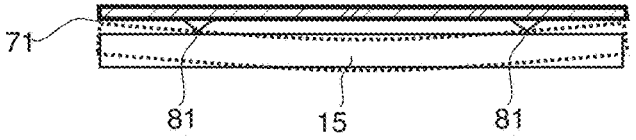
Figure 9F:
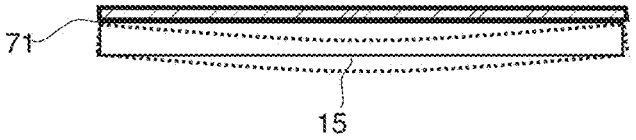

FIGS. 9C and 9E shows an embodiment comprising a second element 71 with a length L and a protruding part 81 at a distance D from each end of the second element. Each protruding part 81 extends a distance H from the second element, which is preferably about a half maximum deviation of a curved sawn timber board. FIGS. 9C and 9D shows a concave sawn timber board arranged above a straight timber board. FIGS. 9E and 9F shows a convex sawn timber board arranged above a straight timber board. FIG. 9D shows the same timber boards as in FIG. 9C, and FIG. 9F shows the same sawn timber boards as in FIG. 9E, but the embodiment shown in FIGS. 9D and 9F is not provided with the protruding parts. A solid batch produced by the embodiment without the protruding parts and with the convex or concave sawn timber boards, may have to be wasted or that a considerable part of the solid batch may have to be cut away and wasted.

Figure 10A:
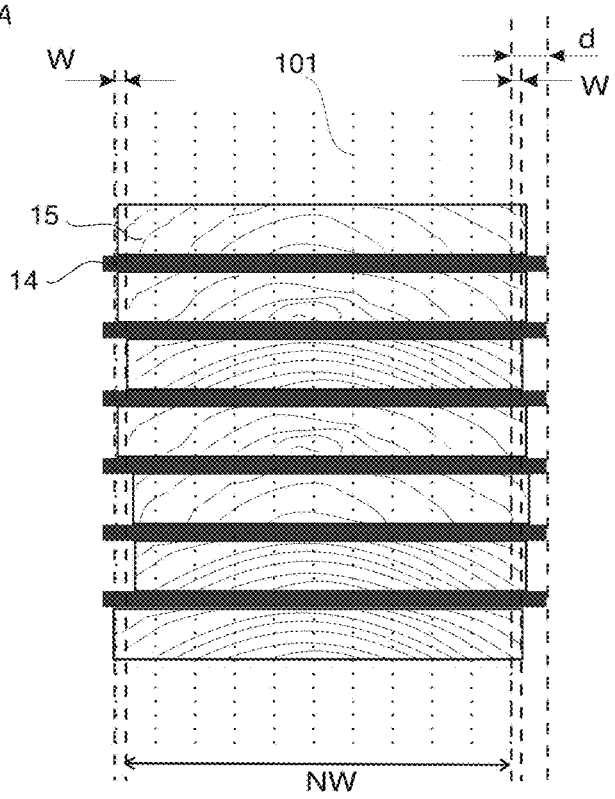
FIGS. 10A-B illustrate batches according to embodiments of the disclosure.
Figure 10B:
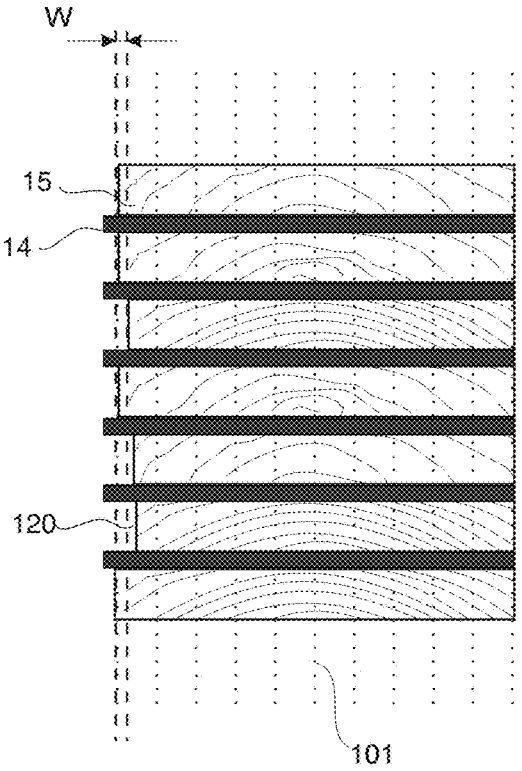
Figure 11A:
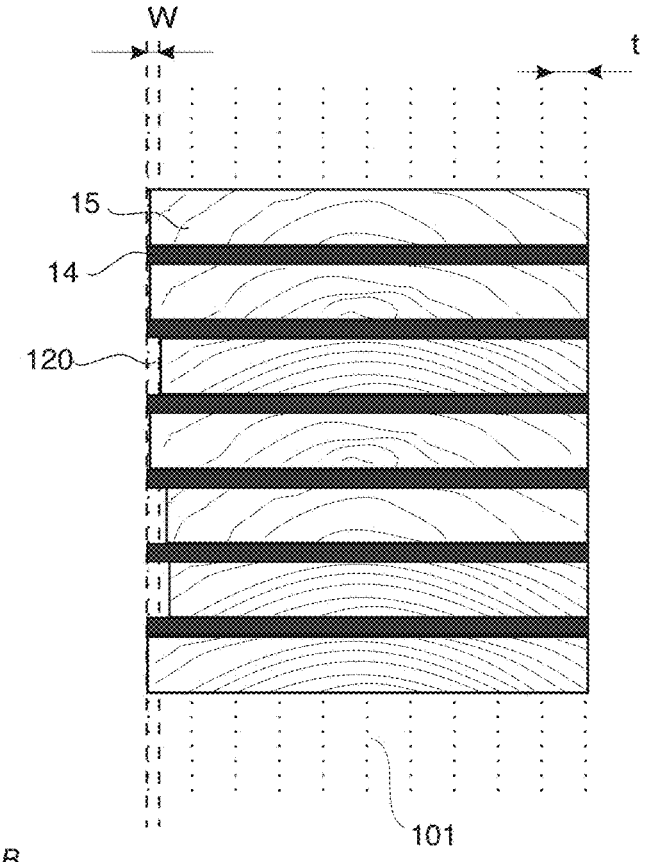
FIGS. 11A-B illustrate batches according to embodiments of the disclosure.
Figure 11B:
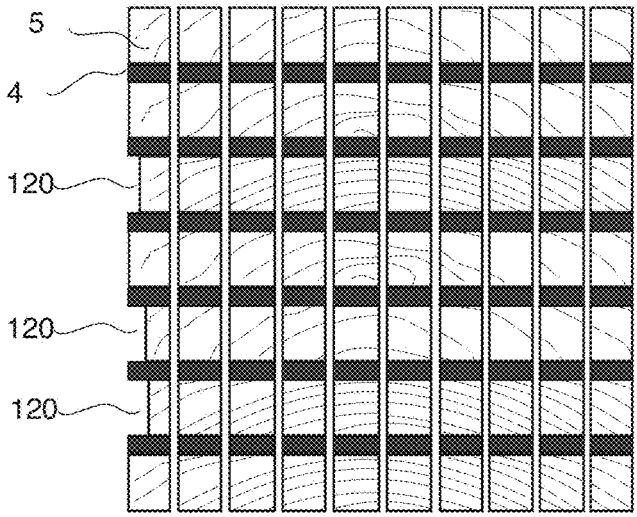

The solid batch is cut in the longitudinal direction of the sawn timber boards along a cutting lines 101 that are essentially perpendicular to a top surface of the sawn timber boards, as is shown in FIGS. 10A-B and 11A. The distance between two adjacent cutting lines 101 is essentially the thickness of the semi product produced. The long edge surfaces of the solid batch may be calibrated, preferably by milling or planing, before the solid batch is cut in the longitudinal direction. This is to avoid or minimize gaps 120 in the semi product, where a part of a wood lamella is missing due to curved timber boards or timber boards of different width. By calibrating the solid batch a part W of the sawn timber is wasted and a part d of the distance strips are wasted. The number of semi products that can be obtained from calibrated batch is the net width NW of the calibrated batch divided by the distance between two adjacent saw cutting lines. It may be desired to have distance strips with a length, which is greater than the width of the sawn timber board. The distance strips 14 may protrude from both the long edge surfaces of the batch, as is shown in FIG. 10A, or the distance strips may only protrude from one of long edge surfaces of the batch, as is shown in FIG. 10B. The advantage is that this decrease the likelihood that it's necessary to calibrate the solid batch due to a missing part of a distance strip. It may be preferred to have an increased waste of distance strips since they may be cheaper than the sawn timber boards. Another advantage is that if parts of two adjacent wood lamellas are missing it is more likely that the distance element between the two adjacent wood lamellas is complete, i.e. that no part of the distance element is missing, see e.g. FIGS. 11B and 12B. This increases the strength of the semi product and consequently also the strength of the building panel provided with the semi product as a core.

FIG. 11A shows an embodiment of a solid batch, which comprises distance strips 14 which have a length, which is equal to the width of the sawn timber board. This may be desired to reduce the waste of the distance strip when the sawn timber boards are sufficiently straight and of essentially the same width.

Figure 12A:
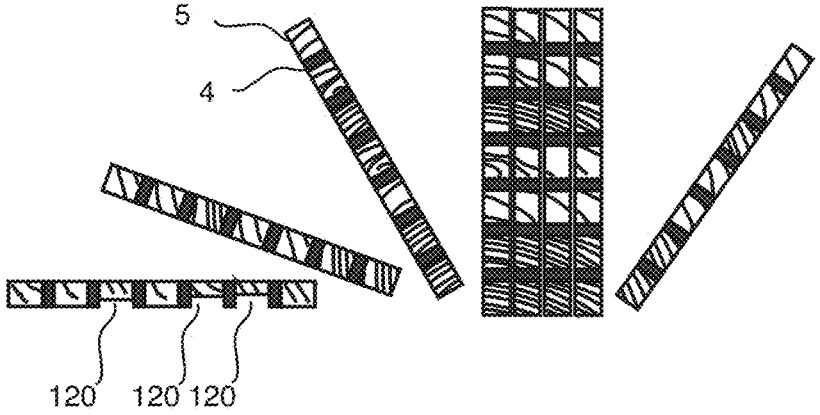
FIGS. 12A-B illustrate a method and a floorboard board according to embodiments of the disclosure.
Figure 12B:
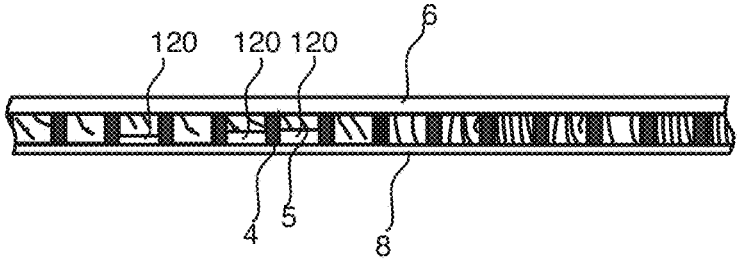

A semi product with a missing part of a wood lamellas and/or a distance element is preferably arranged such that the missing part is positioned at the balancing layer 8 in the ready-made building panel, as is shown in FIG. 12B. This will improve the bonding between the decorative layer 6 and the semi product and the quality of the ready-made building panel. When the solid batch is cut into semi products, outermost semi products of the cut solid batch are preferably rotated in different directions, as is shown in FIG. 12A. This results in that the surfaces of the outermost semi products, which may have a missing part of a wood lamella and/or a distance strip, are oriented in the same direction. This method of arranging a semi product may be used for arranging any semi product for the production of a building panel, also for arranging semi products that are not produced according to the first and/or second aspect.

Figure 12C:
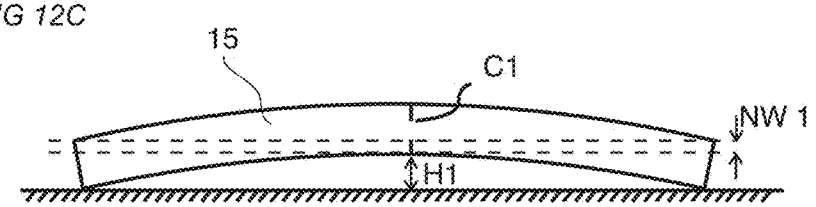
FIGS. 12C-E illustrate methods to cut a sawn timber board according to embodiments of the disclosure.
Figure 12D:
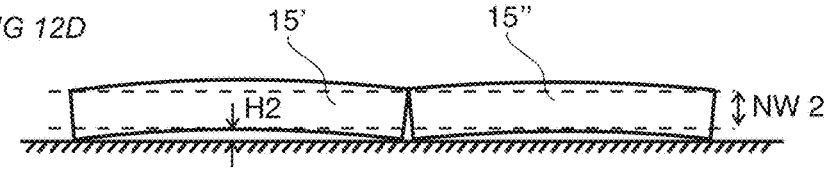

FIGS. 12C-D show a method to cut sawn timber boards for producing a solid batch. The method comprises the step of measuring the deviation H1 of a curved sawn timber board. Curved sawn timber boards with a deviation that exceeds a critical value are cut to obtain shorter sawn timber boards with decreased deviations H2. The deviations H2 of shorter sawn timber boards 15', 15", obtained by cutting a curved sawn timber board in the middle C1, may be a quarter of the deviation H1 of the curved sawn timber board. The net width of a solid batch NW2 comprising the shorter sawn timber boards may therefore be greater than the net width NW1 of a solid batch comprising the curved sawn timber board.

Figure 12E:
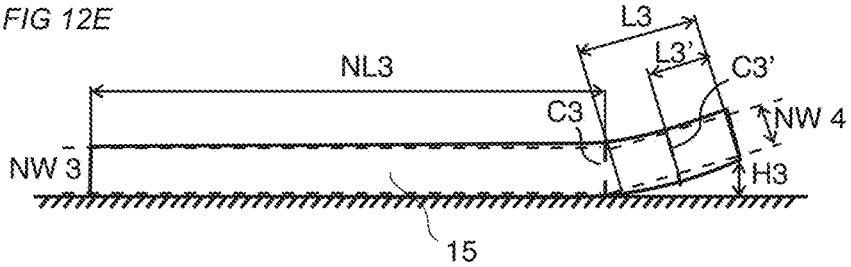

FIG. 12E shows a method comprising the step of measuring the deviation H3 at the end of a curved sawn timber board. Curved sawn timber board with a deviation at its end that exceed a critical value may be cut C3 to obtain an essentially straight sawn timber board with a first length NL3 and a first net width NW3 and a shorter sawn timber board with a second length L3 and a second net width NW4. The shorter sawn timber board and the essentially straight sawn timber board may be used for producing the same solid batch if the first and the second net width are essentially the same. If the difference between the first and the second net width exceeds a critical value the essentially straight sawn timber board may be used for producing a first solid batch and the shorter sawn timber board may be used to produce a second solid batch. A shorter sawn timber board with a deviation that exceeds a critical value may be cut C3' to obtain a shorter sawn timber boards with a decreased deviation, a shorter second length L3', and an increased net width.

EXAMPLE 120 sawn timber boards with a length of 0.85 meters and a nominal width of 100 mm are measured. The measured widths of the sawn timber boards are between 94.2 and 102.5 mm.

The sawn timber boards are arranged to obtain 12 solid batches, each comprising 10 sawn timber board.

The minimum net width NW1 from the 12 solid batches is 90.2 mm.

The minimum net width NW2 from the 12 solid batches with the 16 most curved sawn timber boards cut in the middle is 92.8 mm.

The minimum net width NW2 from the 12 solid batches with the all sawn timber boards cut in the middle is 94.1 mm. This gives an increased yield of 4.3%.

The invention claimed is:

1. Method of producing a semi-product for a building panel, wherein the method comprises:

arranging at least two distance strips, on a first sawn timber board;

arranging a second sawn timber board to the distance strips;

gluing the distance strips to the first and the second sawn timber board, respectively;

positioning of the first and the second sawn timber board and the distance strips by applying a pressure by a first element and a second element, which are arranged along long edges of both the first and the second sawn timber board;

applying a pressure on the first and the second sawn timber board by a third and a fourth element, in a direction perpendicular to a top surface of the second sawn timber board, until the distance strips are bonded to the first and the second sawn timber board and thereby obtaining a solid batch; and cutting of said solid batch in the length direction of the first and the second timber boards.

2. The method as claimed in claim 1, wherein the distance strips are arranged essentially perpendicular to the first sawn timber board.

3. The method as claimed in claim 1, wherein the method comprises calibrating a width of the solid batch before said cutting of said solid batch.

4. The method as claimed in claim 1, wherein a length of the distance strips is longer than a width of the first and second sawn timber boards.

5. The method as claimed in claim 4, wherein at least one of the first and the second element is provided with recesses that match protruding parts of the distance strips, the protruding parts protruding from the first and second sawn timber boards by virtue of being longer than the width of the first and second sawn timber boards.

6. The method as claimed in claim 1, wherein a length of the distance strips is equal or shorter than a width of the first and the second sawn timber board, respectively.

7. The method as claimed in claim 1, wherein at least one of the first and the second element has a planar surface facing the long edges of the first and the second sawn timber boards.

8. The method as claimed in claim 1, wherein at least one of the first and the second sawn timber board is provided with grooves with a width that matches a width of the distance strips.

9. The method as claimed in claim 1, wherein the first and the second sawn timber board are positioned by a applying a pressure by a fifth and a sixth element at short edges of the first and second sawn timber board.

10. The method as claimed in claim 1, wherein the method comprises arranging the first and/or the second sawn timber board against a protruding part of at least one of the first and the second element.

11. The method as claimed in claim 1, wherein the method comprises the step of arranging several other sawn timber boards and other distance strips to the second and/or first sawn timber board.

12. The method as claimed in claim 3, wherein the calibrating of the width of the solid batch is performed by milling or planing.

13. The method as claimed in claim 1, wherein the first and second elements each possess a main surface which is arranged perpendicularly to main surfaces of the first and second sawn timber boards.

14. The method as claimed in claim 1, wherein the at least two distance strips arranged on the first sawn timber board are spaced by at least one gap.

* * * * *